United States Patent [19]

Kim

[11] Patent Number: 5,031,645

[45] Date of Patent: Jul. 16, 1991

[54] CIGARETTE PREMIUM PACKAGING

[76] Inventor: Ki I. Kim, 28109 Highridge Rd., Rancho Palos Verdes, Calif. 90274

[21] Appl. No.: 498,214

[22] Filed: Mar. 22, 1990

[51] Int. Cl.[5] ..... A24F 47/00

[52] U.S. Cl. ..... 131/329; 131/360; D3/57; 40/321; 206/236; 206/237

[58] Field of Search ..... 131/329, 360, 364; 40/321; 446/24; 206/236, 237; 150/132; D3/57

[56] References Cited

U.S. PATENT DOCUMENTS 3,385,302 5/1968 Wattenford ..... 131/360

*Primary Examiner*—V. Millin

*Attorney, Agent, or Firm*—G. Donald Weber, Jr.

[57] ABSTRACT

A unique method of packaging premiums in cigarette packs. The primary concept is to provide instant reward through cash premiums; however, coupons or the like are contemplated.

7 Claims, 1 Drawing Sheet

CIGARETTE PREMIUM PACKAGING

BACKGROUND

1. Field of the Invention

This invention is directed to the distribution of premiums in packages, in general, and to premiums which are packaged in cigarettes or similar products, in particular.

2. Prior Art

There are many types of premium distribution schemes, or givaways, known in the art. Typical examples are the prizes or premiums which are contained in cereal boxes, "Cracker Jack" boxes, or the like. These premiums can take the form of small toys, inexpensive rings, rebate coupons, or the like.

In the past, most of these devices have taken the form of small components which are inserted directly into and intermingled with the product, for example cereal, in the container.

This has the distinct disadvantage of requiring special health considerations in assuring that the prize or premium is maintained sanitary during the process.

Also, this technique has the distinct concern that the prize or premium may be ingested by the consumer.

Moreover, and perhaps most importantly, most of these prizes or premiums are of negligible value and are, at best, novelties or trinkets with little intrinsic or extrinsic value.

PRIOR ART STATEMENT

Applicant has not made a formal patentability search.

SUMMARY OF THE INSTANT INVENTION

This invention is directed to a premium or prize distribution concept directed primarily to cigarette (or similar) manufacturers. Preferably, a prize in the form of currency (i.e. a dollar bill) is rolled into a coil and inserted into a hollowed-out cylinder which represents a cigarette or the like. The premium-carrying cigarette is inserted into a conventional package (e.g. soft pack or box) and distributed in that fashion.

The consumer opens the package, removes the premium-containing cigarette, removes the premium and obtains instant reward in the event of a cash premium. Delayed or deferred awards can be provided in terms of coupons or the like, if required because of U.S. Treasury (or other agency) regulations, health considerations and/or the like.

DESCRIPTION OF THE PREFERRED EMBODIMENT

Figure 1:
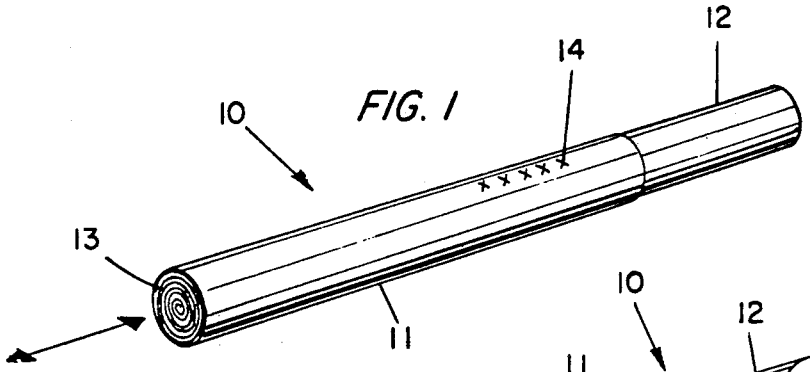
FIG. 1 is a isometric view of a the modified cigarette with a premium therein.

Referring now to FIG. 1, there is shown an isometric view of a typical cylindrical cigarette 10 or similar tobacco product. Typically, the cigarette 10 includes a standard paper wrapper 11, which is formed in an elongated, hollow cylindrical manner and adapted to retain tobacco or other products therein. In FIG. 1, the cigarette 10 includes a filter tip 12, which may or may not be utilized with the paper wrapper 11. That is, the invention will operate similarly with or without a filter tip.

Suitable indicia 14 can be placed on the wrapper 11 to identify the manufacturer or the brand of the cigarette 10.

In the preferred embodiment, the cigarette !0 is, in fact, a "dummy" cigarette. That is, cigarette lo does not include any tobacco or other smoking materials. Rather, a rolled or coiled currency bill 13 is inserted into the paper tube 11. The magnitude or denomination of bill 13 can be any size selected. In U.S. currency, all currency bills are the same size, color and dimensions. Consequently, the coiled bill 13 is substantially universally adaptable. It has been determined that U.S. currency, especially when coiled, is very difficult to ignite, consequently, the chances of inadvertently igniting and smoking such a "dummy" cigarette are remote.

In any event, the indicia 14 could be arranged to indicate that the cigarette 10 is, in fact, a premium-bearing unit rather than a conventional unit. The indicia could be words, colors, characters or any other suitable symbol.

Figure 2:
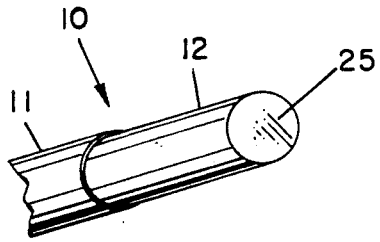
FIG. 2 is a fragmentary end view of a premium cigarette including an indicia therein.

Referring now to FIG. 2, there is shown an alternative arrangement for identifying the premium-bearing cigarette. In this case, the filter 12 can incorporate and include a suitable indicia 25 thereon. The indicia 25 can take the form of a suitable character, symbol or the like, or it can merely be a special marking, a special coloration, or the like.

In addition, it is conceivable that the filter 12 will not be an operable filter but would be a solid unit through which the draft would not occur. Thus, the "dummy" or premium-carrying cigarette can be both visually and functionally identifiable.

Figure 3:
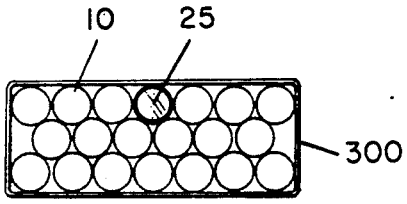
FIG. 3 is a top view of a cigarette-containing package including a premium-carrying product.

Referring now to FIG. 3, there is shown the top view of the open end of a cigarette pack. In particular, this arrangement is used for a pack 300, which opens and exposes all of the cigarettes therein. Typically, a cigarette pack incorporates groups of twenty (20) therein. In this case, a plurality of cigarettes 10 are described with a single cigarette including an indicia 25 thereon. By appropriate selection of the indicia 25, the premium-carrying cigarette is highly visible and discernible by the consumer.

While not shown in FIG. 3, the filter tip or end could be otherwise modified to prevent the inadvertent utilization of the premium-carrying cigarette in a darkened or low visibility situation.

Figure 4:
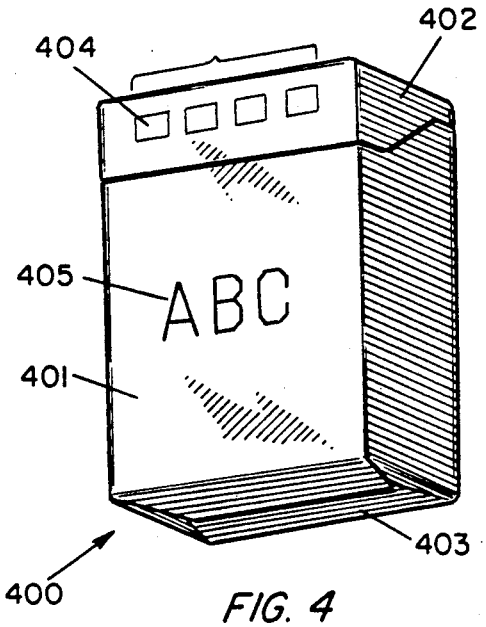
FIG. 4 is a perspective view of a conventional hard box container for cigarettes.

Referring now to FIG. 4, there is shown a "hard pack" 400. The package includes a main body 401 and a hinged lid 402. The conventional folded bottom 403 is depicted, as well. The appropriate brand name or logo 405 is suggested on the front of the package. The logo may be depicted elsewhere on the package, as well.

Also, at the hinged lid or "flip-top" 402, appropriate indicia 404 is included on at least one surface. This indicia may comprise one or more units. Each of these units can take the form of a coded number or symbol. In addition, the indicia 404 can be of the "scratch-off" type of coded display. By selecting the proper indicia 404 of the proper code, a premium can be selected. This premium can be retrievable at the dealer or in a "mail-in" rebate program.

Figure 5:
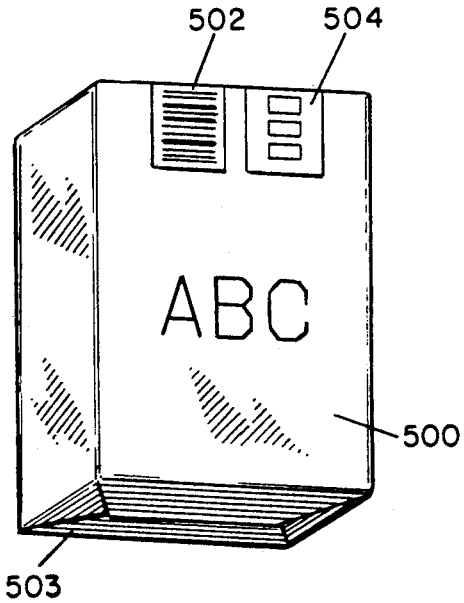
FIG. 5 is a perspective view of a conventional soft pack container for cigarettes.

Referring now to FIG. 5, there is shown a representative display of a conventional soft pack 500 containing cigarettes. Again, a package bottom 503 is suggested. The typical cigarette or tobacco tax stamp 502 is shown illustratively. In addition, a separate band 504 can be placed over the upper portion of the cigarette pack 500 in a manner similar to the tax stamp 502. The code symbol band 504 can be selectively removable and used to redeem a premium immediately at the purveyor of the cigarettes or through on a mail-in (or similar) redemption process.

The redemption process has a slight advantage in that the value of the cigarettes, per se, is reduced over the package or carton which may include a cash premium. However, it is also well-known that consumers are very much interested in obtaining instant gratification of their pleasures. In this regard, it is highly desirable to have the currency bill 13 in the form of actual cash. Of course, a redemption coupon of any configuration including including "play money" could be utilized.

The indicia 404 or the band 503 (or the rolled premium 13) can be arranged to have any suitable coding thereon, including typical bar codes, computer readable codes or the like.

Thus, there is shown and described a unique design and concept of a cigarette premium packaging method. The particular configuration shown and described herein relates to a cash, coupon or redeemable premium. While this description is directed to particular embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A premium package comprising, a hollow cigarette-like unit, and a premium formed of a thin sheet of flexible material which is rolled and inserted into said hollow cigarette-like unit, said premium comprises a currency bill.

2. The package recited in claim 1 wherein, said cigarette-like unit includes a filter tip at one end thereof.

3. The package recited in claim 1 including, indicia for indicating a premium value in a cigarette-like unit.

4. The package recited in claim 4 wherein, said indicia is provided in said cigarette-like unit.

5. The package recited in claim 4 wherein, said indicia is provided on a pack which encloses said cigarette-like unit.

6. The package recited in claim 1 wherein, said premium comprises a coupon which is redeemable for a specified value.

7. The package recited in claim 1 wherein said currency bill comprises legal tender money.

* * * * *